US009896812B2

(12) United States Patent
Doerr

(10) Patent No.: US 9,896,812 B2
(45) Date of Patent: Feb. 20, 2018

(54) MOUNTING DEVICE FOR A DEBRIS DEFLECTOR

(71) Applicant: Michael Robert Doerr, Cheswick, PA (US)

(72) Inventor: Michael Robert Doerr, Cheswick, PA (US)

( * ) Notice: Subject to any disclaimer, the term of this patent is extended or adjusted under 35 U.S.C. 154(b) by 368 days.

(21) Appl. No.: 14/720,939

(22) Filed: May 25, 2015

(65) Prior Publication Data

US 2015/0345089 A1 Dec. 3, 2015

Related U.S. Application Data

(60) Provisional application No. 62/003,523, filed on May 27, 2014.

(51) Int. Cl.
*E01H 8/10* (2006.01)
*B61G 11/00* (2006.01)

(52) U.S. Cl.
CPC ..... *E01H 8/10* (2013.01)

(58) Field of Classification Search
CPC ..... B61F 15/06; B61F 45/008; B61F 19/04; B61G 11/00; B61G 11/02; B61G 11/08; B61G 11/10; B61G 11/12; B61G 11/14; B61G 11/16; B61G 11/18
See application file for complete search history.

(56) References Cited

U.S. PATENT DOCUMENTS

| | | | | |
|---|---|---|---|---|
| 289,705 | A | 12/1883 | Phillips | |
| 5,348,363 | A | 9/1994 | Fink | |
| 6,688,021 | B2 | 2/2004 | Baig et al. | |
| 7,694,633 | B2 | 4/2010 | Mayer | |
| 7,810,437 | B2 * | 10/2010 | Mattschull | B60R 19/14 105/392.5 |

FOREIGN PATENT DOCUMENTS

| | | |
|---|---|---|
| EP | 1930227 | 2/2013 |
| WO | WO 2003/016119 | 2/2003 |

* cited by examiner

*Primary Examiner* — Robert J McCarry, Jr.
(74) *Attorney, Agent, or Firm* — Mainline Intellectual Property; Syam Anand

(57) ABSTRACT

Methods and systems for a mounting device for mounting debris deflector to transportation vehicles such as light rail which helps to position the deflector at the front or rear end of vehicles are disclosed. The mounting device is located between the deflector and transportation vehicle and includes a longitudinal member having a proximal end and a distal end, a first base plate rigidly connected to the proximal end of the longitudinal member, and a second base plate rigidly connected to the distal end of the longitudinal member. Further, the first base plate may be connected to understructure of the transportation vehicle, and the second base plate may be connected to the debris deflector.

16 Claims, 5 Drawing Sheets

MOUNTING DEVICE FOR A DEBRIS DEFLECTOR

CLAIM OF PRIORITY

This application claims priority to the Provisional Application No. 62/003,523 filed on May 27, 2014 entitled "Mounting Device For a Debris Deflector," which is incorporated herein by reference in its entirety.

BACKGROUND

Debris deflectors have been routinely used in front of the locomotives to remove debris such as snow, tree branches, and the like from the train tracks that obstruct or affect the safe operation of the train. Current methods and devices to mount debris deflectors on to locomotive are cumbersome when it comes to safety, operation, control, ease of attachment and removal and convenience. Further, the attachment of debris deflectors need to be tailored for each type of locomotive, and depend on the type and shape of the locomotive. Such methods are not economical and are time consuming. Thus, there is a great need in the rail-road industry for devices to mount debris deflectors with ease, and methods to attach and remove debris deflectors.

SUMMARY

Disclosed herein are methods and devices to attach a debris deflector to a transportation vehicle. In one embodiment, a mounting device for mounting a debris deflector on a transportation vehicle includes at least one longitudinal member having a proximal end and a distal end, a first base plate having an upper surface and a lower surface, the lower surface attached to the proximal end of the longitudinal member, and the upper surface attached to understructure of the transportation vehicle. The device further includes a second base plate having an upper surface and a lower surface, and the upper surface attached to the distal end of the longitudinal member. Further, the second base plate has an extended surface away from a region attached to the longitudinal member, and the extended surface is attached to the debris deflector.

In another embodiment, a method of attaching a debris deflector to a transportation vehicle involves providing a mounting device comprising at least one longitudinal member having a proximal end and a distal end, the proximal end connected to a lower surface of a first base plate, and the distal end connected to an upper surface of a second base plate. The method further involves connecting an upper surface of the first base plate to an understructure of a transportation vehicle by one or more attachment elements, and connecting the second base plate to the debris deflector by one or more attachment elements.

In an additional embodiment, a kit for mounting a debris deflector to a transportation vehicle includes a mounting device comprising at least one longitudinal member having a proximal end and a distal end, and the proximal end rigidly connected to a lower surface of a first base plate, and the distal end rigidly connected to an upper surface of a second base plate. The kit further includes a plurality of mounting devices, a plurality of attachment elements, and a plurality of debris deflectors.

DETAILED DESCRIPTION

Figure 1:
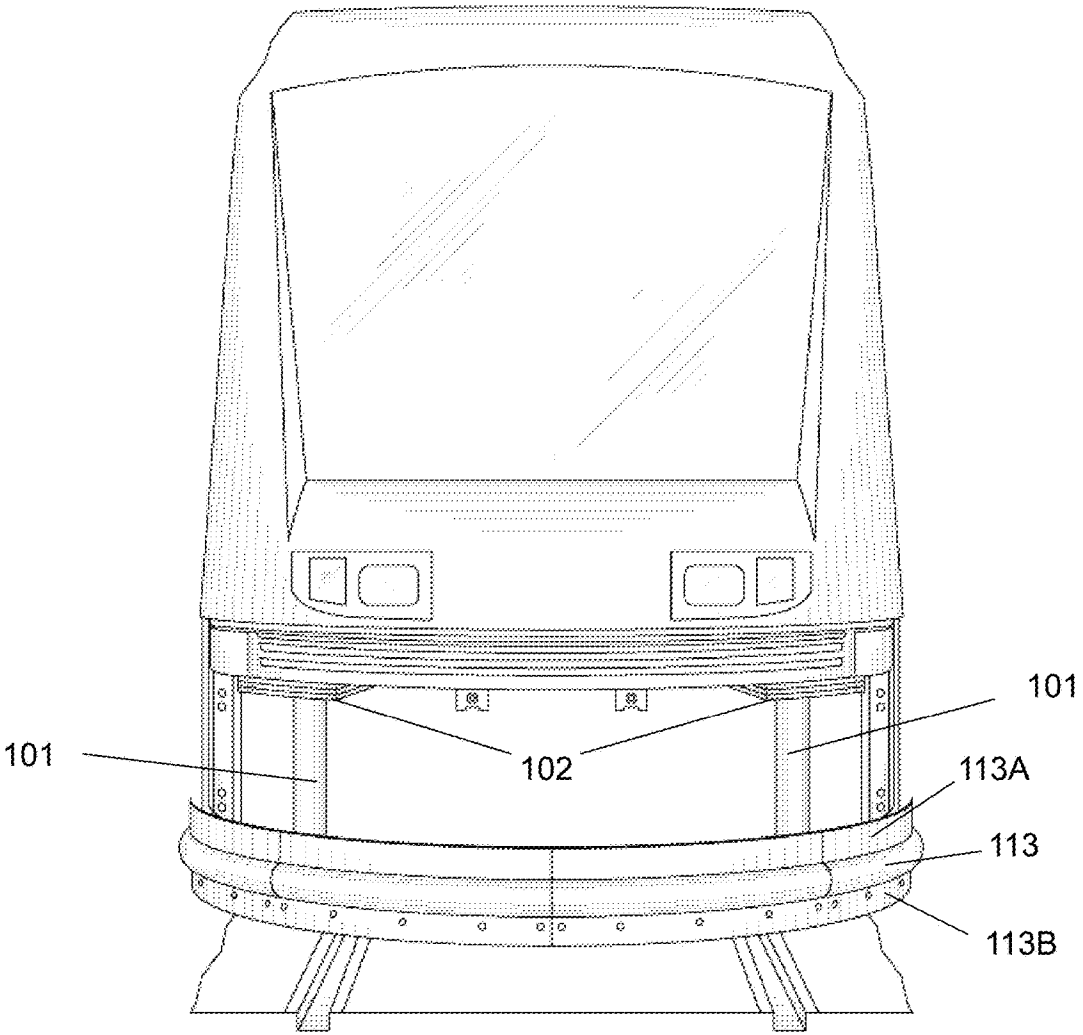
FIG. 1 depicts a pair of mounting devices with a debris deflector attached to the front end of a light rail according to an embodiment.
Figure 2:
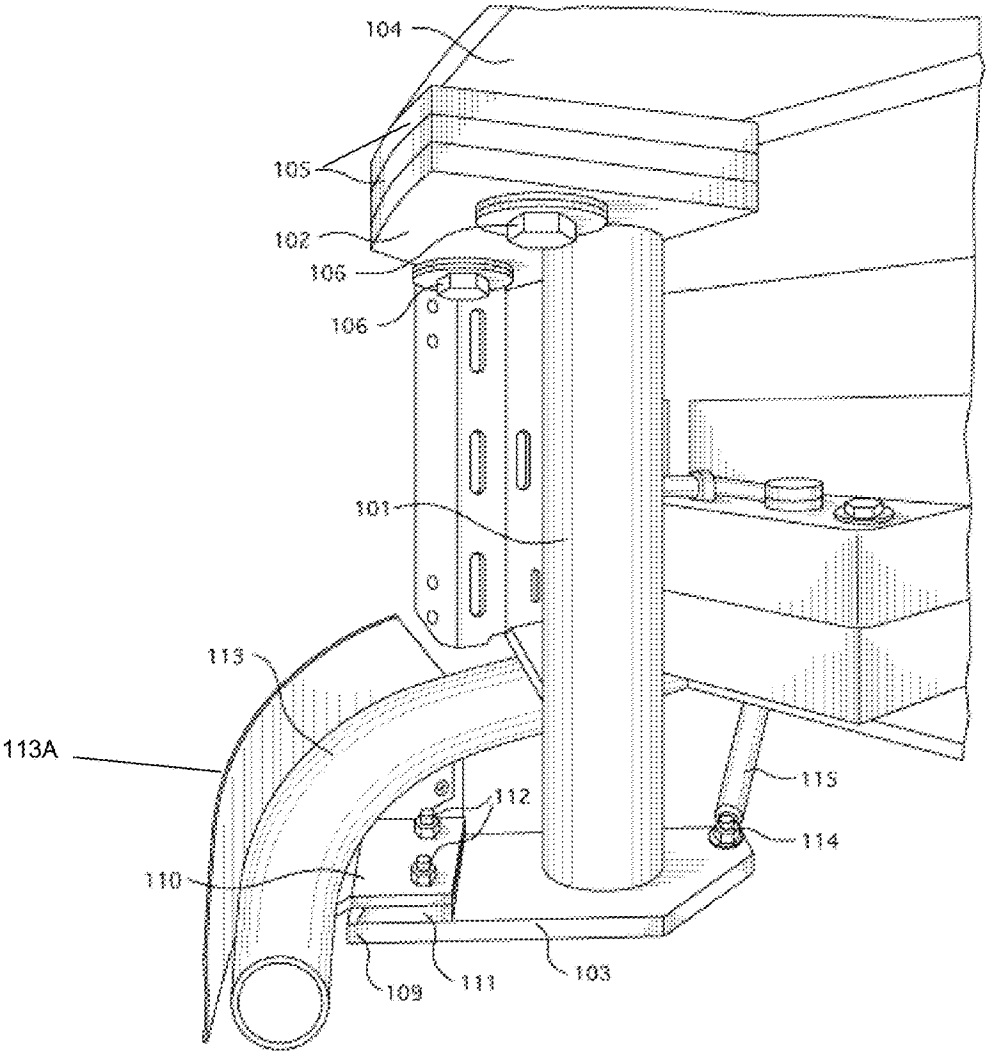
FIG. 2 depicts a single mounting device, and the attachments of the longitudinal member to the first and second base plates.

FIG. 1 illustrates an exemplary embodiment of a pair of mounting devices with a debris deflector attached to front end of a light rail. As shown in FIG. 2, each mounting device includes a longitudinal member 101 attached to a first base plate 102 at the proximal or top end, and a second base plate 103 at the distal or bottom end. The longitudinal member can be of any shape, such as rod shape, cylindrical, square, hexagonal, and the like, and is generally made of a solid metal, such as steel, iron, or any other rigid metal. In other embodiments, the longitudinal member may be a hollow metal cylinder or a metal pipe. An exemplary cylindrical longitudinal member 101 is shown in FIG. 2. The cylindrical member may have a diameter of about 2 inches to about 12 inches, and a length of about 1 foot to about 6 feet. The length of the longitudinal member may vary depending on the ground clearance between the undersurface of the light rail and the tracks. The longitudinal member 101 is generally perpendicular to the tracks when mounted on the light rail, but in some embodiments, may also be inclined at an angle. Further, the longitudinal member may provide rigidity and strength to support the debris deflector, and to withstand the impact when the debris deflector comes in contact with debris.

As shown in FIG. 2, the proximal end of the longitudinal member 101 is attached to lower surface of the first base plate 102. The first base plate 102 is generally made of solid metal, such as steel, and may have a thickness of about 0.5 inch to about 6 inches. The first base plate may be of any shape, such as a square, a rectangle, circular, a triangle, and the like, and is intended to attach the longitudinal member to the understructure of the light rail. The lower surface of the first base plate 102 is generally attached to the longitudinal member 101 rigidly by welding. In some embodiments, other attachment elements, such as anchoring screws, clamps, bolts, rivets, pins, nuts, or any combination thereof may be used. The upper surface of the first base plate 102 is attached to the understructure of the light rail, for example an anti-climber plate, by one or more attachment elements. The attachment elements may be anchoring screws, clamps, bolts, rivets, pins, nuts, or any combination thereof. In some embodiments, the first base plate may also be welded rigidly to the understructure of the light rail.

Figure 3:
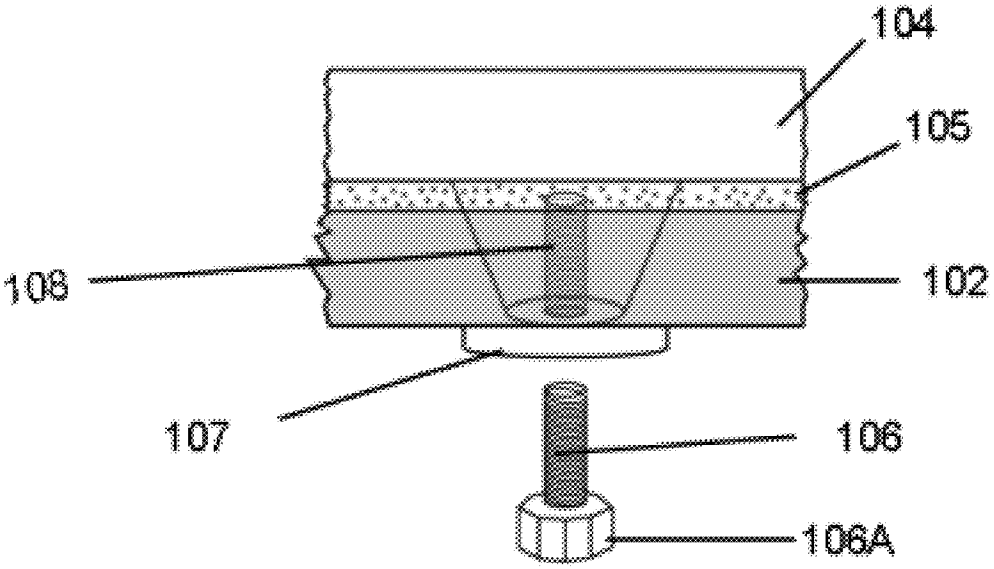
FIG. 3 depicts the first base plate assembly attached to the understructure of the light rail according to an embodiment.

The first base plate assembly attached to the understructure of a light rail is illustrated in FIG. 3. In some embodiments, the upper surface of the first base plate 102 is attached to the understructure of the transportation vehicle by one or more attachment elements. The understructure of the transportation vehicle may be the underside of the frame or the structure of the vehicle. Non-limiting examples of vehicle understructure may be rail understructure, such as anti-climber plate, undercarriage crossmember, long member, and the like. A preferred embodiment may be anti-climber plate 104. In other embodiments, the anti-climber plate may be present at front end, rear end, or both ends of the transportation vehicle and the mounting device may present at one or both ends of the transportation vehicle. The first base plate 102 may be made of any solid metal, such as steel, iron, and the like. The first base plate 102 may have a thickness of about 0.5 inch to about 6 inches and may be of any shape, such as a square, a rectangle, a triangle, and the like. The first base plate assembly may further include a polymer material 105 between the first base plate 102 and the anti-climber plate 104. The polymer material may act as a vibration damping material and cushion the vehicle or light rail from any impact, thereby preventing further damage to the vehicle. Non-limiting examples of the polymer material may be a polyether, a polyester, a polycarbonate, a polycaprolactone, a polyacrylic, a polystyrene, a polyamide, a polyurethane, a polyolefin, a poly(etherether-ketone), a perfluoroalkoxy polymer or any combination thereof. Other polymeric materials that may be used are vinyl chloride resins, vinylidene chloride resins, vinyl chloride-vinylidene chloride copolymers, polyethylene resins, vinyl chloride-vinyl acetate copolymers, and the like. The thickness of the polymer material may be from about 0.25 inch to about 3 inches. In some embodiments, a plurality of polymer material 105 may be present (FIG. 2).

The attachment element connecting the first base plate 102 to the anti-climber plate 104 may be welding, anchoring screws, clamps, bolts, rivets, pins, nuts, or any combination thereof. An example attachment element may be a bolt 106, as shown in FIG. 3. For example, a bolt (without a head) may be welded on to the anti-climber plate. The polymer material 105 and the first base plate 102 may be threaded through the bolt with the help of a groove 108. The groove 108 may run through the polymer material 105 and the first base plate 102. The polymer material and the first base plate may be secured by a nut 106A. The bolt may further include a steel mounting washer 107. A thread-lock sealant may be used to secure the bolt into the groove 108. In some embodiments, a plurality of bolts 106 may be welded to the anti-climber plate, and the first base plate 102 may be attached.

As shown in FIG. 2, the upper surface of the second base plate 103 is attached to distal end of the longitudinal member 101. The second base plate 103 is generally made of solid metal, such as steel, and may have a thickness of about 0.5 inch to about 6 inches. The second base plate may be of any shape, such as a square, a rectangle, circular, a triangle, and the like. The upper surface of the second base plate 103 is generally attached to the longitudinal member rigidly by welding. In some embodiments, other attachment elements, such as anchoring screws, clamps, bolts, rivets, pins, nuts, or any combination thereof may be used. Further, the second base plate may have an extended surface 109 that extends away from the region attached to the longitudinal member. The extended surface 109 may support the debris deflector 113. In some embodiments, the extended surface 109 of the second base plate may include brackets 110 to support the debris deflector 113. The brackets may be secured to the extended surface 109 by one or more attachment elements, such as bolts 112. However, any attachment element, such as angled brackets, bolts, clamps, and the like may be used. Further, a polymer material 111 may be present between the bracket 110 and the extended surface 109 of the second base plate. The polymer material 111 may be any polymer material described herein and may act as a vibration damping material. Further, in the event the debris deflector 113 comes in contact with harder or heavier objects, such as rocks, the bracket 110 or the attachment elements 112 may break-off or give away from the mounting device and buffer the energy of impact.

Figure 4:
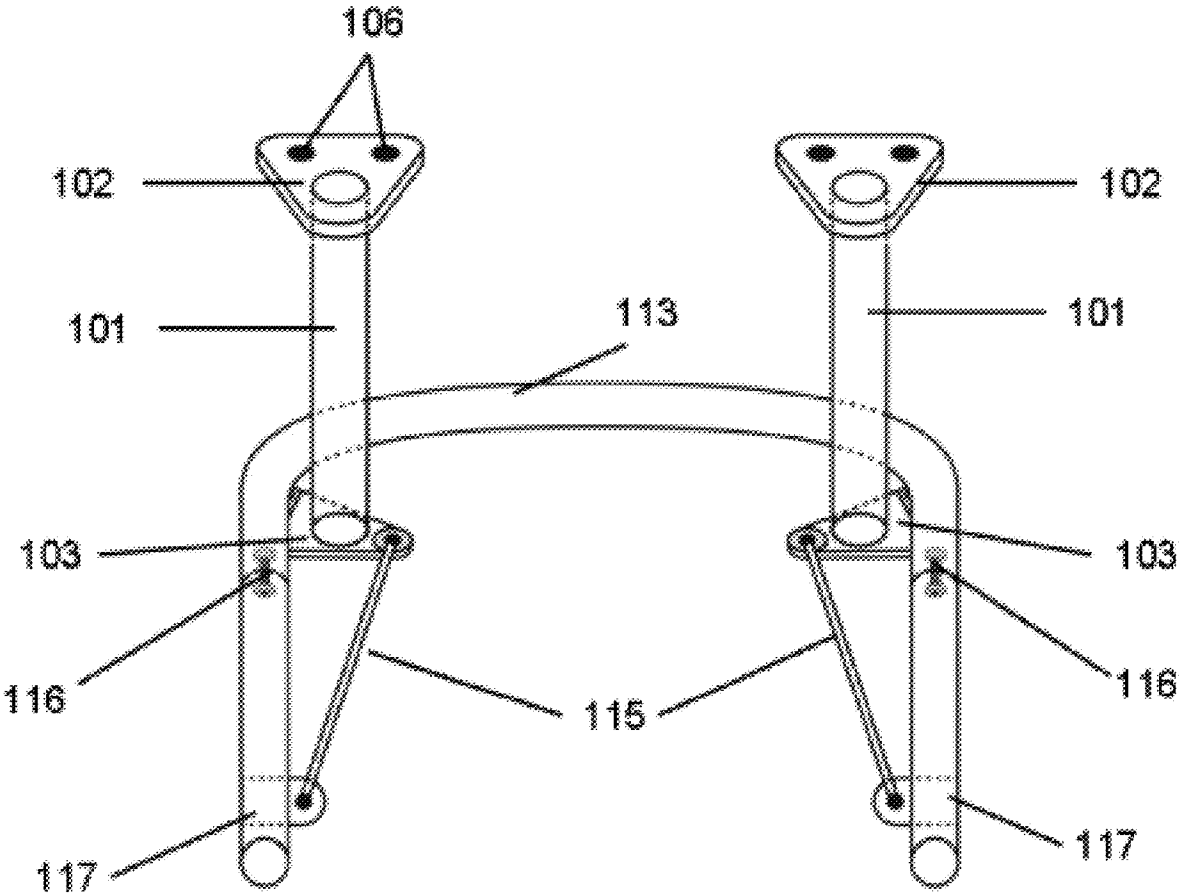
FIG. 4 is a back view showing a pair of mounting devices supporting a debris deflector according to an embodiment.
Figure 5:
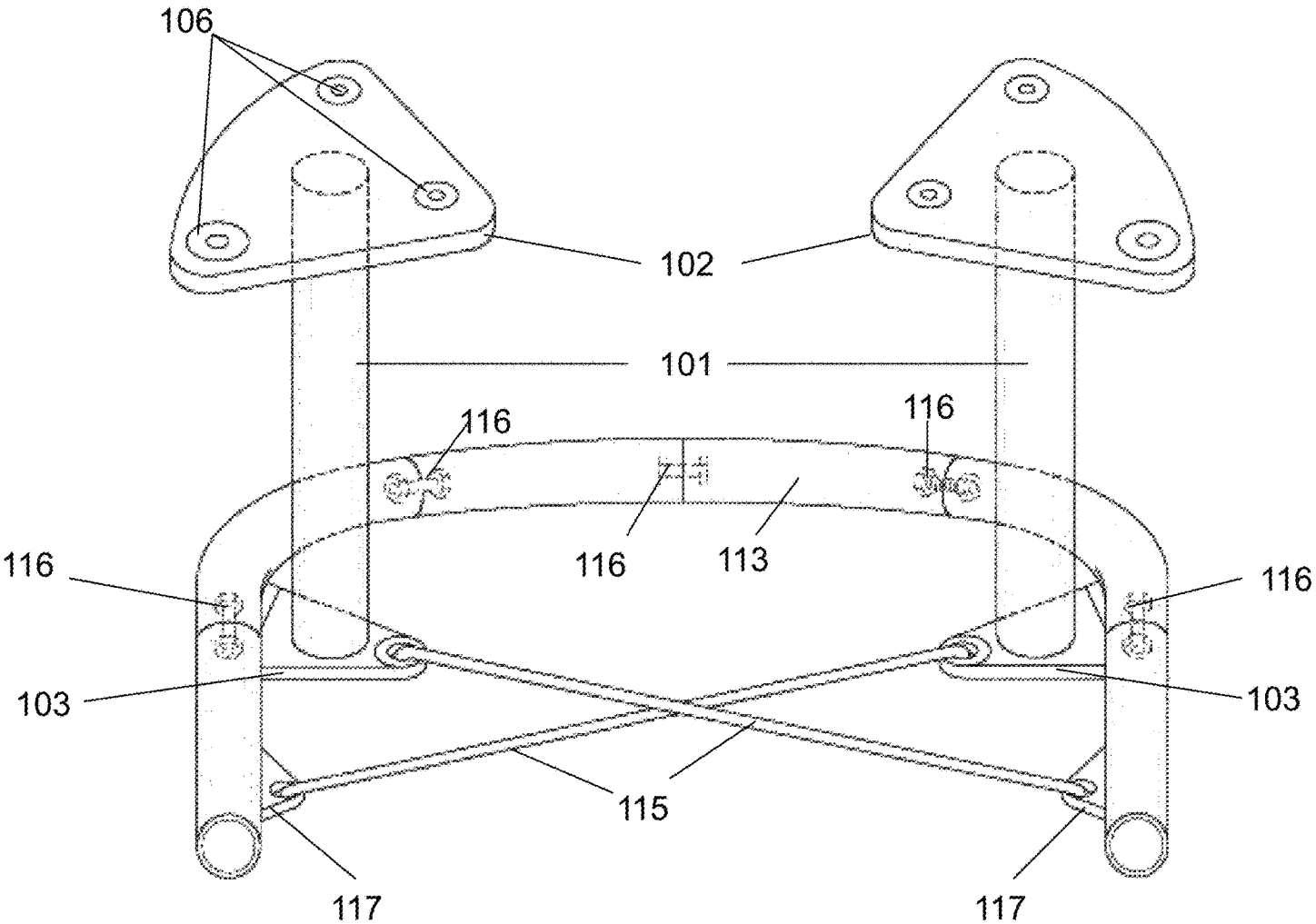
FIG. 5 is a back view showing a pair of mounting devices supporting a debris deflector according to an embodiment.

The second base plate 103 may be further reinforced by additional attachments to the understructure of the light rail, such as one or more connecting members 115 as shown in FIG. 2, FIG. 4, and FIG. 5. The connecting member 115 may hold the second base plate 103 and the mounting device in place and prevent oscillations. The connecting member 115 may be flexible, such as a tensionable cord member and may be attached to the second base plate by attachment element, such as a bolt 114 (FIG. 2).

In some embodiments, the debris deflector may be supported by one or more mounting devices. For example, a pair of mounting devices may support the debris deflector, as shown in FIG. 1. A pair of mounting devices may be connected to the anti-climber plate present at the front end of the light rail. Further, the debris deflector may be in any shape, such as a v-shaped structure, a cylindrical tube, a vertical flap, an arc-shaped structure, or a wedge-shaped structure. An exemplary debris deflector 113 as shown in FIG. 5 may be cylindrical in shape. The connecting members 115 may connect the second base plate 103 and the rear end of the debris deflector 117, and may prevent the debris deflector from oscillations. In some embodiments, the connecting members may cross over each other and are connected to the opposite side of the debris deflector, as shown in FIG. 5. The debris deflector 113 may be a single piece or contiguous pieces joined by attachment elements, such as screws 116. In the event of damage to the debris deflector itself, a debris deflector assembled from contiguous pieces will allow convenient and economical replacement of just the damaged piece instead of the entire deflector.

The debris deflector 113 in FIG. 1 may further comprise upward extensions 113A and downward extensions 113B. These upward extensions and downward extensions may be made of any polymeric material, such as polyurethane. The flexible nature of polyurethane will make the deflectors absorb and dampen the shocks from potential impacts and thereby further protect the main body of the transportation vehicle. Thus they reduce the amount of energy of impact that is transferred directly to the occupants of the transportation vehicle. Further, upward extensions 113A and downward extensions 113B may be a continuous piece or may be joined from contiguous pieces. Further, individual pieces may be replaced if damaged.

The distance between the debris deflector and the ground (ground clearance) may be adjusted by the thickness of the bracket 110. For example, a thicker bracket will increase the ground clearance of the debris deflector. A thinner bracket will decrease the ground clearance of the debris deflector. Further, the ground clearance can also be adjusted by varying the length of the downward extensions 113B of the debris deflector 113.

Further, the debris deflector may extends substantially full width of the front end or the back end of the transportation vehicle, such as light rail. When assembled, the mounting device may hold the debris deflector vertically in the front or rear end of the transportation vehicle. Although the figures and other embodiments in this disclosure refer to light rail, the mounting device described herein may be assembled on any transportation vehicle, such as a freight train, a locomotive, an army vehicle, or a road transportation vehicle. Further, the debris deflector described herein may be used to remove debris from tracks, such as snow, tree branches, shopping carts, tires, rocks, dead animals, and the like.

It will be appreciated that the understructure of trains varies considerably for different classes of trains. As such, the mounting device attached to the understructure according to the present invention may vary considerably for different classes of trains. Furthermore, the size and arrangement of the deflectors themselves may also vary for different classes of trains. The mounting device may allow the entirety or parts of the deflector to retain rigidity or allow flexibility. Further, the mounting device may help to fasten or remove the debris deflector from the transportation vehicle with ease. The mounting device described herein allows to attach the debris deflector to the train without interfering with the coupler of the train or light rail. For example, the debris deflector need not be removed for coupling two adjacent passenger cars or for coupling an engine and a passenger car.

Also disclosed herein are methods to attach a debris deflector to a transportation vehicle. In some embodiments, the method includes providing a mounting device having at least one longitudinal member 101 with a proximal end and a distal end. The proximal end of the longitudinal member is attached to a lower surface of a first base plate 102, and the distal end attached to an upper surface of a second base plate 103. Further, the method includes attaching the upper surface of the first base plate to an understructure 104 of a transportation vehicle by one or more attachment elements, and attaching the second base plate 103 to the debris deflector 113 by one or more attachment elements. In some embodiments, the second base plate may have an extended surface 109 that extends away from the region attached to the longitudinal member. The extended surface 109 may support the debris deflector 113.

Also disclosed herein is a kit for mounting a debris deflector to a transportation vehicle. The kit may include a mounting device having a longitudinal member 101 with a proximal end and a distal end, and the proximal end rigidly connected to the lower surface of a first base plate 102, and the distal end rigidly connected to the upper surface of a second base plate 103. The kit may further contain a plurality of attachment elements. These attachment elements may be used to attach the upper surface of the first base plate to an underside of a transportation vehicle 104. The attachment elements may further be used to connect the debris deflector 113 to the extended surface 109 of second base plate 103. The kit may further contain instructions for attaching the mounting device and the debris deflector to the transportation vehicle.

The mounting device described herein may act as an intermediary between the debris deflector and the train, and may decrease the impact on the body of the train by providing additional rigidity to the debris deflector. Further, the mounting device described herein may reduce the costs associated with assembling and mounting debris deflectors on to various types of locomotives without altering the shape or size of the debris deflectors. The mounting device may allow easy and quick removal of the debris deflector from the locomotive when a large debris is stuck between the debris deflector and the tracks.

While preferred embodiments have been shown and described, various modifications and substitutions may be made thereto without departing from the spirit and scope of the method and device. Accordingly, it is to be understood that the present method and device has been described by way of illustration and not limitation.

What is claimed is:

1. A mounting device for a debris deflector on a transportation vehicle, the mounting device comprising:

at least one longitudinal member having a proximal end and a distal end;

a first base plate having an upper surface and a lower surface, the lower surface attached to the proximal end of the longitudinal member and the upper surface attached rigidly to an understructure of the transportation vehicle;

the longitudinal member oriented perpendicular to the understructure of the transportation vehicle;

a second base plate having an upper surface and a lower surface, and the upper surface attached to the distal end of the longitudinal member; and the second base plate having an extended surface away from a region attached to the longitudinal member, and the extended surface is attached to the debris deflector.

2. The mounting device of claim 1, wherein the longitudinal member comprises a hollow metal pipe having a diameter of about 2 inches to about 12 inches, and a length of about 1 foot to about 6 feet.

3. The mounting device of claim 1, wherein the lower surface of the first base plate is attached to the proximal end of the longitudinal member rigidly.

4. The mounting device of claim 1, wherein the upper surface of the second base plate is attached to the distal end of the longitudinal member rigidly.

5. The mounting device of claim 1, wherein the upper surface of the first base plate is attached to understructure of the transportation vehicle by one or more attachment elements.

6. The mounting device of claim 1, wherein the extended surface of the second base plate is attached to the debris deflector by one or more attachment elements.

7. The mounting device of claim 1, wherein the device further comprises a polymer material between the upper surface of the first base plate and the understructure of the transportation vehicle.

8. The mounting device of claim 7, wherein thickness of the polymer material is from about 0.25 inch to about 3 inches.

9. The mounting device of claim 1, further comprising a connecting member connecting the second base plate to the debris deflector.

10. The mounting device of claim 1, wherein the first base plate is a solid metal and has a thickness of about 0.5 inch to about 6 inches.

11. The mounting device of claim 1, wherein the second base plate is a solid metal and has a thickness of about 0.5 inch to about 6 inches.

12. The mounting device of claim 1, wherein the mounting device comprises a plurality of mounting devices attached to a debris deflector.

13. The mounting device of claim 1, wherein the mounting device is present at one or both ends of the transportation vehicle.

14. The mounting device of claim 1, wherein the debris deflector is a v-shaped structure, a cylindrical tube, a vertical flap, an arc-shaped structure, or a wedge-shaped structure.

15. The mounting device of claim 1, wherein the mounting device is configured to hold the debris deflector vertically in front of the transportation vehicle.

16. The mounting device of claim 1, wherein the transportation vehicle is a light rail, a freight train, a locomotive, an army vehicle, or a road transportation vehicle.

* * * * *